US010670239B2

(12) United States Patent
Li

(10) Patent No.: US 10,670,239 B2
(45) Date of Patent: Jun. 2, 2020

(54) FIXING CLIP FOR LIGHT STRIP

(71) Applicant: GUANGDONG OML TECHNOLOGY CO., LTD, Zhongshan, Guangdong (CN)

(72) Inventor: Xiaobing Li, Guangdong (CN)

(73) Assignee: GUANGDONG OML TECHNOLOGY CO., LTD, Zhongshan (CN)

( * ) Notice: Subject to any disclaimer, the term of this patent is extended or adjusted under 35 U.S.C. 154(b) by 0 days.

(21) Appl. No.: 16/266,001

(22) Filed: Feb. 2, 2019

(65) Prior Publication Data

US 2019/0390842 A1 Dec. 26, 2019

(30) Foreign Application Priority Data

Jun. 20, 2018 (CN) ..... 2018 2 0956760 U

(51) Int. Cl.
*F21V 19/00* (2006.01)
*F21S 4/28* (2016.01)

(52) U.S. Cl.
CPC ..... *F21V 19/00* (2013.01); *F21S 4/28* (2016.01); *F21V 19/004* (2013.01)

(58) Field of Classification Search
CPC ..... F21V 19/00; F21V 15/013; F21V 17/002; F21V 19/003; F21V 17/104; F21V 17/16; F21V 17/00; F21V 17/006; F21V 17/004; F21V 21/025; F21V 17/10; F21V 17/164; F21V 23/009; F21V 7/00; F21V 21/008; F21V 9/00; F21V 21/044; F21V 21/0034; F21V 21/08; F21V 21/088; F21V 23/06; F21V 15/01; F21V 23/007; F21V 21/049; F21V 19/004; F21K 9/20; F21Y 2115/10; F21Y 2103/00; F21Y 2103/10; F21S 8/02; F21S 4/28; F21S 8/026; F21S 4/00; F21S 2/00; F21S 8/04
See application file for complete search history.

(56) References Cited

U.S. PATENT DOCUMENTS 5,823,829 A * 10/1998 Suzuki ..... H01R 33/05 439/668
2010/0195317 A1* 8/2010 Oketani ..... A47F 3/001 362/125

(Continued)

FOREIGN PATENT DOCUMENTS

CN 102951535 B 10/2014
CN 205402342 * 7/2016 ..... F21S 4/00

*Primary Examiner* — Britt D Hanley
*Assistant Examiner* — Fatima N Farokhrooz

(57) ABSTRACT

Fixing clip for light strip is disclosed, which comprises a body and an elastic member, the body is provided with a slot capable of accommodating the light strip, the elastic member is disposed in the slot; a side wall of the slot is provided with a block laterally extending, the elastic member comprises a pressing portion, and an upper end of the pressing portion abuts against the block; the pressing portion can be pressed against a side wall of the light strip to prevent the light strip from sliding out of the slot. By implementing the present disclosure, the light strip can be effectively prevented from slipping out of the slot, and the reliability thereof is high, and no glue or mounting screws are required, which simplifies the assembly process of the light strip and is convenient for the mounting of the light strip.

7 Claims, 2 Drawing Sheets

(56) References Cited

U.S. PATENT DOCUMENTS

| | | | | |
|---|---|---|---|---|
| 2011/0297971 | A1* | 12/2011 | Shimizu | F21S 8/04<br>257/88 |
| 2015/0292719 | A1* | 10/2015 | Park | F21V 21/049<br>362/221 |
| 2016/0281937 | A1* | 9/2016 | Grigore | F21V 33/006 |

* cited by examiner

FIXING CLIP FOR LIGHT STRIP

CROSS-REFERENCE TO RELATED APPLICATIONS

The present application claims the benefit of Chinese Utility Model Application No. 201820956760.3 filed on Jun. 20, 2018, the entire contents of which are hereby incorporated by reference.

FIELD OF THE INVENTION

The present disclosure relates to an installing component for light strip, in particularly to a fixing clip for a light strip.

BACKGROUND OF THE INVENTION

Generally, a slot is provided on the body according to the existing method of installing the light strip, and the light strip is fixed in the slot. If the gap between the light strip and the slot is large, the light strip easily slides out of the slot. In order to prevent the light strip from slipping out of the slot, the existing technical solutions adopt methods like reducing the gap between the slot and the light strip, applying glue between the light strip and the slot, and fixing the strip in the slot by using screws. However, the above method complicates the installing process of the light strip, and the disassembly and re-installing of the light strip is also cumbersome. In addition, if the gap between the strip and the slot is small, it will make it difficult for the light strip to be clipped in the slot.

Chinese Patent CN102951535B discloses a fixing device for an escalator apron light strip, comprising a light strip clip, the light strip clip having a pair of elastic hooks, wherein the pair of elastic hooks can clip the lighting strip respectively on the upper and lower sides, to achieve fixing the lighting strip. However, the elastic hooks are easily inserted into the housing of the light strip, thus damaging the structure of the strip, because the housing of the strip is typically plastic. In addition, the above patent fixes the light strip by means of elastic hooks, which is also inconvenient for the assembly and disassembly of the strip. Furthermore, the above patent requires that the portion of the light strip clip be removed to enable the light strip to be clipped in the slot.

SUMMARY OF THE INVENTION

The technical problem to be solved by the embodiments of the present invention is to provide a fixing clip for light strip, which can effectively prevent the light strip from sliding out of the slot, and is convenient to assemble the light strip and the slot.

In order to solve the above problem, the present disclosure provides a fixing clip for a light strip, wherein the fixing clip comprises a body and an elastic member, the body is provided with a slot capable of accommodating the light strip, the elastic member is disposed in the slot; a side wall of the slot is provided with a block laterally extending, the elastic member comprises a pressing portion, and an upper end of the pressing portion abuts against the block; the pressing portion can be pressed against a side wall of the light strip to prevent the light strip from sliding out of the slot.

As an improvement of the above technical solution, the improved elastic member comprises a lower positioning portion, an extending portion and a pressing portion; the lower positioning portion comprises a positioning base piece and a positioning side piece which is formed when both sides of the positioning base piece is bent upward respectively; the extending portion comprises a lateral elastic piece which is formed when the positioning side piece is bent downward, the lateral elastic piece is connected to the pressing portion.

As an improvement of, a groove is disposed on the block, and the upper end of the pressing portion is inserted into the groove.

As an improvement of, a width of an opening portion of the elastic member is larger than a width of a middle portion of the elastic member.

As an improvement of, the pressing portion is a curved sheet.

As an improvement of, the elastic member comprises two pressing portions, and the two pressing portions are disposed opposite to each other.

As an improvement of, a side wall of the pressing portion is provided with a protrusion for contacting the side wall of the light strip.

As an improvement of, the slot is provided with a lower positioning cavity and an extension cavity, and the lower positioning portion extends into the lower positioning cavity. An edge of the extension cavity is provided with a first inclined plane and a second inclined plane, the first inclined plane is located below the extending portion, and the second inclined plane is located between the upper portion of the pressing portion and the sidewall of the slot As an improvement of, the positioning base piece is provided with a positioning protrusion protruding downward, and the positioning protrusion abuts against the bottom of the slot.

As an improvement of, the positioning base piece is further provided with a reinforcing rib perpendicular to an extending direction of the light strip.

By implementing the present disclosure, the beneficial effects are as follows:

Firstly, according to the fixing clip for the light strip of the present disclosure, by providing the elastic member in the slot, the light strip can be effectively prevented from slipping out of the slot, and the reliability thereof is high, and no glue or mounting screws are required, which simplifies the assembly process of the light strip and is convenient for the mounting of the light strip, and facilitates the use of the present disclosure.

Secondly, the elastic member is elastically deformed, thus the light strip is easily clipped in the slot, thus resolving the problem of difficult installation of the lamp strip. An upper portion of the elastic member is longitudinally and laterally positioned by the groove of the slot; the bottom of the slot abuts against the positioning protrusion of the elastic member to perform the lower longitudinal positioning; a lower positioning cavity of the slot cooperates with the positioning side piece of the elastic member to perform the lower lateral positioning to reduce shaking of the light strip relative to the body, thus the assembly is more reliable.

In addition, when the light strip is clipped by the elastic member, the pressing portion is moved towards the direction of the slot until contacting the second inclined plane, and there is a definite distance between an end of the second inclined plane and the side wall of the slot. The slope of the second inclined plane can contribute to clamping the light strip and maintain the pressing portion with the necessary are so that the pressing portion maintains the clamping force on the light strip for a long time.

DETAILED DESCRIPTION OF THE INVENTION

In order to make the objects, technical solutions and advantages of the present invention more apparent, the present invention will be further described in detail with reference to the accompanying drawings. In this regard, the words "upper, lower, left, right, front, back, inside, and outside" appearing or to appear in the text herein are only with respect to the drawings of the present invention, which are not specific to limit the present invention.

Figure 1:
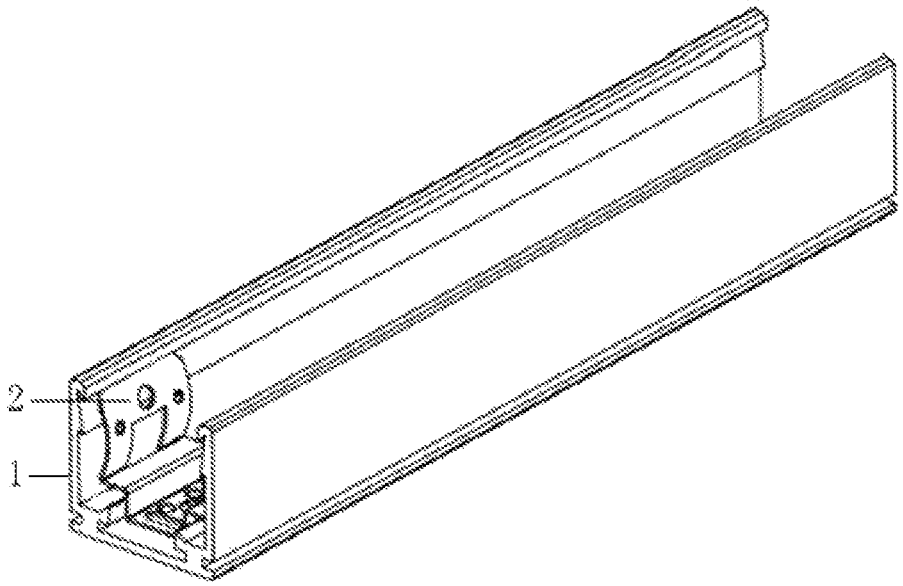
FIG. 1 is a three dimensional structure diagram of a fixing clip for a light strip according to the present disclosure.
Figure 2:
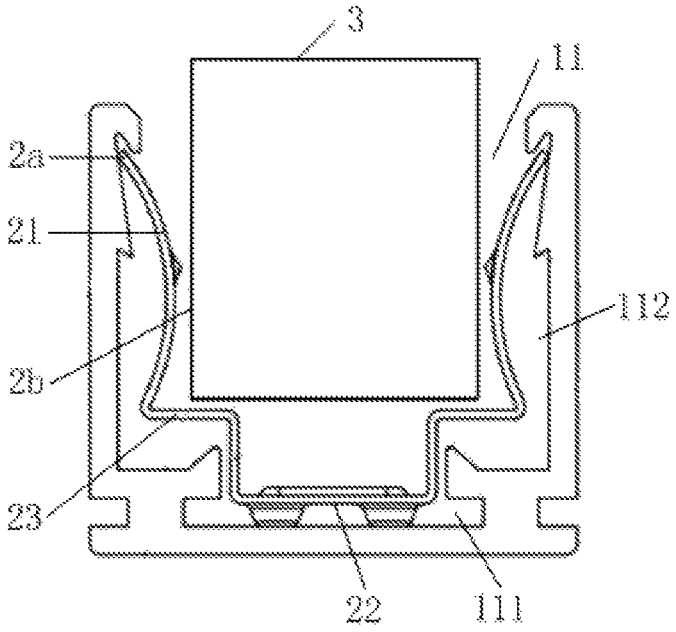
FIG. 2 is a working status diagram of a fixing clip for a light strip according to the present disclosure.
Figure 3:
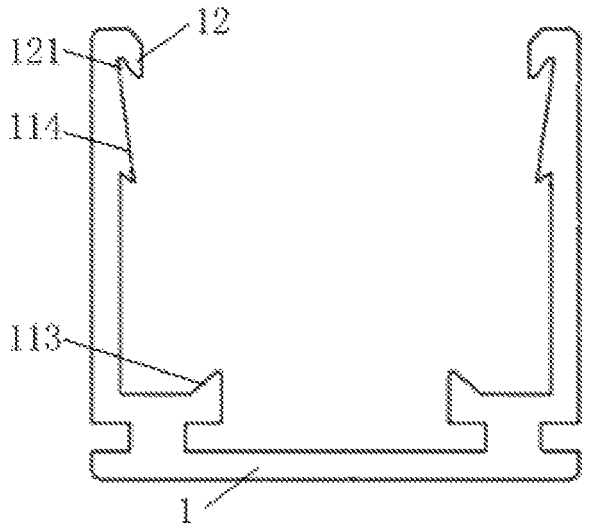
FIG. 3 is a schematic view of a body according to the present disclosure.

With reference to FIG. 1 to FIG. 3, a specific embodiment of the present invention provides a fixing clip for a light strip, which comprises a body 1 and an elastic member 2, and the body 1 is provided with a slot 11 capable of accommodating the light strip, the elastic member 2 is disposed in the slot 11; a side wall of the slot 11 is provided with a block 12 laterally extending, the elastic member 2 comprises a pressing portion 21, and an upper end of the pressing portion 21 abuts against the block 12; the pressing portion 21 can be pressed against a side wall of the light strip 3 to prevent the light strip 3 from sliding out of the slot 11. In order to further fix the upper end of the pressing portion 21, a groove 121 may be disposed on the block 12, and the upper end of the pressing portion 21 is inserted into the groove 121.

The elastic member 2 comprises two pressing portions 21, and the two pressing portions 21 are disposed opposite to each other. The light strip 3 is sandwiched between the two pressing portions 21, and the two sides of the lamp belt 3 are evenly stressed to prevent the light strip 3 from being excessively biased to one side of the slot 11. In other embodiments of the present application, the elastic member 2 may be provided with only one pressing portion 21, and the light strip 3 is sandwiched between the pressing portion 21 and the body 1.

In order to facilitate the assembly and disassembly of the light strip 3, the pressing portion 21 is curved as an arc shape, and the pressing portion 21 is curved to be convex toward an axial direction such that a width of an opening portion 2*a* of the elastic member 2 is larger than a width of a middle portion 2*b* of the elastic member 2. Therefore, the light strip 3 is conveniently assembled in the slot 11, and the light strip 3 is also easily disassembled from the slot 11.

In order to enlarge a contact surface between the pressing portion 21 and the light strip 3, the pressing portion 21 is a sheet, and when the light strip 3 is caught in the slot 11, the pressing portion 21 is elastically deformed and pressed on the side wall of the light strip 3, as to increase the force of friction between the pressing portion 21 and the light strip 3, and this structure enables the light strip 3 to be relatively easily inserted in the slot 11. Further, the pressing portion 21 may be bent as a trapezoidal shape or the like, also the pressing portion 21 may be strip-shaped.

In order to facilitate the elastic deformation of the pressing portion 21, the pressing portion 21 is further provided with a hole and/or a vacant portion.

A side wall of the pressing portion 21 is provided with a protrusion 211 for contacting the side wall of the light strip 3 to further increase the frictional resistance between the pressing portion 21 and the light strip 3, thereby preventing the strip 3 from sliding out of the slot 11. The shape of the protruding portion 211 is tapered, circular, elliptical, semi-circular, triangular, barbed, or the like.

Figure 4:
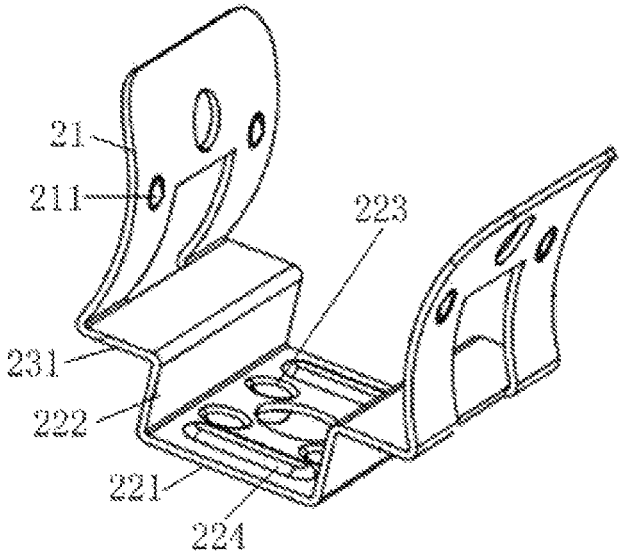
FIG. 4 is a schematic view of a plastic member according to the present disclosure.

With reference to FIG. 4, in order to enable the elastic member 2 to be easily and securely mounted in the body 1, the structure of the elastic member 2 can be further improved. The improved elastic member 2 comprises a lower positioning portion 22, an extending portion 23 and a pressing portion 21; the lower positioning portion 22 comprises a positioning base piece 221 and a positioning side piece 222 which is formed when both sides of the positioning base piece 221 is bent upward respectively; The extending portion 23 comprises a lateral elastic piece 231 which is formed when the positioning side piece 222 is bent downward, and the lateral elastic piece 231 is connected to the pressing portion 21. The positioning base piece 221 is provided with a positioning protrusion 223 protruding downward, and the positioning protrusion 223 abuts against the bottom of the slot 11. A group is consisted of four positioning protrusions 223, the positioning base piece 221 is further provided with reinforcing ribs 224 perpendicular to an extending direction of the light strip 3, and the reinforcing ribs 224 are disposed on both sides of a group of positioning protrusions 223 and bulging upwards. The positioning protrusions 223 are disposed on the four corners of the rectangle and abut against the bottom of the slot 11 to form a stable supporting surface. The reinforcing ribs 224 are long striped and perpendicular to the extending direction of the light strip 3, thereby preventing the positioning base piece 221 from bending to ensure that the two pressing portions 21 are forced evenly. An upper portion of the elastic member 2 is longitudinally and laterally positioned by the groove 121 of the slot 11; The bottom of the slot 11 abuts against the positioning protrusion 223 of the elastic member 2 to perform the lower longitudinal positioning; a lower positioning cavity of the slot 11 cooperates with the positioning side piece 222 of the elastic member 2 to perform the lower lateral positioning to reduce shaking of the light strip 3 relative to the body 1, thus the assembly is more reliable.

The slot is provided with 11A lower positioning cavity 111 and an extension cavity 112, and the lower positioning portion 22 extends into the lower positioning cavity 111. An edge of the extension cavity 112 is provided with a first inclined plane 113 and a second inclined plane 114, the first inclined plane 113 is located below the extending portion 23, and the second inclined plane 114 is located between the upper portion of the pressing portion 21 and the sidewall of the slot 11. When the light strip is clipped by the elastic member 2, the pressing portion 21 is moved towards the direction of the slot 11 until contacting the second inclined plane 114, and there is a definite distance between an end of the second inclined plane 114 and the side wall of the slot 11. The slope of the second inclined plane 114 can contribute to clamping the light strip 3 and maintain the pressing portion 21 with the necessary are so that the pressing portion 21 maintains the clamping force on the light strip 3 for a long time. When the pressing portion 21 is compressed, the lateral elastic piece 231 is pushed downward until it abuts against the first inclined surface 113, and as the pressing portion 21 is further compressed, the lateral elastic piece 231 slowly moves downward along the first inclined plane 113, thus providing sufficient space for the deformation of the pressing portion 21, and assisting the pressing portion 21 to press the light strip 3 with its own elastic force. Under the joint action of the pressing portion 21 and the lateral elastic piece 231, the light strip 3 is fast, permanently and securely fixed to the body 1.

In the present invention, the pressing portion 21 is longitudinally bent, that is, the pressing portion 21 can longitudinally extend in the slot 11. Undoubtedly, in actual application, the pressing portion 21 can also be laterally bent, that is, the pressing portion 21 can extend along the length direction of the slot 11.

In the present disclosure, the main body of the elastic member 2 is in sheet form that is, the lower positioning portion 22, the extending portion 23 and the pressing portion 21 are all in sheet form, and the elastic member 2 is processed by bending, stamping, or/and the like of a sheet, thus the cost of the processing of the elastic member 2 is decreased, and the elastic member 2 as a whole can be elastically deformed, making it easier to be assembled in the slot 11.

In practical applications, the pressing portion 21 can also be in other structural forms. For example, the pressing portion 21 can be in flat sheet form and inclined to the side wall of the slot 11. When the light strip 3 is placed in the slot 11, the pressing portion 21 is swung toward the side wall of the slot 11 by the light strip 3, while the pressing portion 21 is pressed against the side wall of the light strip 3. To facilitate the assembly of the light strip 3, the end of the pressing portion 21 are bent to form an inclined guide portion.

As described above, by providing the elastic member 2 in the slot 11, the light strip 3 can be effectively prevented from slipping out of the slot 11, and the reliability thereof is high, and no glue or mounting screws are required, which simplifies the assembly process of the light strip 3 and the mounting of the light strip 3, and facilitates the use of the present disclosure.

The above are only preferred embodiments of the present invention, and the scope of the present invention is not limited thereto, and thus equivalent motivations made in the claims of the present invention are still within the scope of the present invention.

What is claimed is:

1. A fixing clip for a light strip, wherein the fixing clip comprises a body and an elastic member, the body is provided with a slot capable of accommodating the light strip, the elastic member is disposed in the slot; a side wall of the slot is provided with a block extending laterally, the elastic member comprises a pressing portion, an upper end of the pressing portion abuts against the block; the pressing portion can be pressed against a side wall of the light strip to prevent the light strip from sliding out of the slot;

the elastic member comprises a lower positioning portion, an extending portion and a pressing portion; the lower positioning portion comprises a positioning base piece and a positioning side piece which is formed when both sides of the positioning base piece is bent upward respectively; the extending portion comprises a lateral elastic piece which is formed when the positioning side piece is bent downward, the lateral elastic piece is connected to the pressing portion;

the positioning base piece is provided with positioning protrusions which are protruding downward, and the positioning protrusions abut against the bottom of the slot;

the positioning base piece is further provided with reinforcing ribs perpendicular to an extending direction of the light strip; the reinforcing ribs are disposed on both sides of a group of positioning protrusions and bulging upwards.

2. The fixing clip for the light strip according to claim 1, wherein a groove is disposed on the block, and the upper end of the pressing portion is inserted into the groove.

3. The fixing clip for the light strip according to claim 1, wherein a width of an opening portion of the elastic member is larger than a width of a middle portion of the elastic member.

4. The fixing clip for the light strip according to claim 1, wherein the elastic member comprises two pressing portions, and the two pressing portions are disposed opposite to each other.

5. The fixing clip for the light strip according to claim 1, wherein a side wall of the pressing portion is provided with a protrusion for contacting the side wall of the light strip.

6. The fixing clip for the light strip according to claim 1, wherein the slot is provided with a lower positioning cavity and an extension cavity, and the lower positioning portion extends into the lower positioning cavity; an edge of the extension cavity is provided with a first inclined plane and a second inclined plane, the first inclined plane is located below the extending portion, and the second inclined plane is located between the upper portion of the pressing portion and the sidewall of the slot.

7. The fixing clip for the light strip according to claim 3, wherein the pressing portion is a curved sheet.

* * * * *